US008596741B2

(12) United States Patent
Kawai et al.

(10) Patent No.: US 8,596,741 B2
(45) Date of Patent: Dec. 3, 2013

(54) INK-JET PRINTER

(71) Applicants: Narumi Kawai, Nagoya (JP); Yoshitsugu Morita, Nagoya (JP); Shingo Hattori, Nagoya (JP); Hiroto Sugahara, Aichi-ken (JP)

(72) Inventors: Narumi Kawai, Nagoya (JP); Yoshitsugu Morita, Nagoya (JP); Shingo Hattori, Nagoya (JP); Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/933,952

(22) Filed: Jul. 2, 2013

(65) Prior Publication Data

US 2013/0293614 A1 Nov. 7, 2013

Related U.S. Application Data

(63) Continuation of application No. 12/404,997, filed on Mar. 16, 2009, now Pat. No. 8,500,229.

(30) Foreign Application Priority Data

Mar. 25, 2008 (JP) ..... 2008-078119

(51) Int. Cl.
*B41J 29/38* (2006.01)

(52) U.S. Cl.
USPC ..... 347/14

(58) Field of Classification Search
USPC ..... 347/14
See application file for complete search history.

(56) References Cited

U.S. PATENT DOCUMENTS

| | | | | |
|---|---|---|---|---|
| 6,113,290 | A | 9/2000 | Tanaka et al. | |
| 2003/0081019 | A1* | 5/2003 | Frolik et al. | 347/5 |
| 2004/0125186 | A1 | 7/2004 | Matsui | |
| 2005/0024401 | A1* | 2/2005 | Oshio et al. | 347/9 |
| 2005/0062777 | A1 | 3/2005 | Tsai | |
| 2007/0057985 | A1 | 3/2007 | Saito et al. | |
| 2007/0154250 | A1 | 7/2007 | Cahill et al. | |
| 2009/0079777 | A1 | 3/2009 | Nagamura et al. | |

FOREIGN PATENT DOCUMENTS

| | | | |
|---|---|---|---|
| EP | 1256455 | A1 | 11/2002 |
| JP | S61-283544 | A | 12/1986 |
| JP | 2001-121841 | A | 5/2001 |
| JP | 2002-052861 | A | 2/2002 |
| JP | 2004-142205 | A | 5/2004 |
| JP | 2004-330668 | A | 11/2004 |
| JP | 2005-271298 | A | 10/2005 |
| JP | 2006-056068 | A | 3/2006 |

OTHER PUBLICATIONS

European Patent Office, European Search Report for European Patent Application No. 09155538.3 (counterpart to co-pending U.S. Appl. No. 12/404,997), dated Feb. 11, 2011.

(Continued)

*Primary Examiner* — Laura Martin
(74) *Attorney, Agent, or Firm* — Baker Botts L.L.P.

(57) ABSTRACT

An ink-jet printer including: an ink supply portion; a transport mechanism; an ink-jet head; an inverting mechanism; and a controller is provided. The controller is configured to control the ink-jet head to perform an ordinary jetting operation and a marking jetting operation, and is configured to control the ink-jet head and the inverting mechanism such that only the ordinary jetting operation is performed on the one surface of the printing medium without performing the marking jetting operation, and the marking jetting operation is performed on the other surface of the printing medium after inverting the printing medium with the inverting mechanism.

1 Claim, 16 Drawing Sheets

(56) References Cited

OTHER PUBLICATIONS

Japan Patent Office, Decision to Grant a Patent for Japanese Patent Application No. 2010-192298 (counterpart to co-pending U.S. Appl. No. 12/404,997), mailed Sep. 27, 2011.

Japan Patent Office, Decision to Grant a Patent for Japanese Patent Application No. 2010-192299 (counterpart to co-pending U.S. Appl. No. 12/404,997), mailed Sep. 27, 2011.

Japan Patent Office, Decision to Grant a Patent for Japanese Patent Application No. 2010-192300 (counterpart to co-pending U.S. Appl. No. 12/404,997), mailed Sep. 27, 2011.

* cited by examiner

INK-JET PRINTER

CROSS REFERENCE TO RELATED APPLICATION

The present application claims priority from Japanese Patent Application No. 2008-078119, filed on Mar. 25, 2008, the disclosure of which is incorporated herein by reference in its entirety. The present application is a continuation application of U.S. patent application Ser. No. 12/404,997 filed on Mar. 16, 2009.

BACKGROUND OF THE INVENTION

1. Field of the Invention

The present invention relates to an ink-jet printer which performs the printing by jetting ink liquid droplets onto a printing medium.

2. Description of the Related Art

Conventionally, a technique is known in the field of the printing apparatus, in which a marking is applied or affixed to a side end portion of a printing medium on which, for example, images and letters are printed. Such a marking is often formed, for example, in order that a desired page can be easily found by a person who takes a book by the hand when a large number of printing paper sheets are stacked and bound to form the book such as a magazine or a dictionary. In relation to the ink-jet printer for forming the marking at the side end portion of the printing medium as described above, Japanese Patent Application Laid-open No. 2006-56068 (FIG. 1) describes an ink-jet printer, wherein the borderless printing function is diverted so that the regular printing (printing of, for example, desired images and/or letters) is performed on a central portion of a printing medium, and ink liquid droplets are also jetted onto an edge portion (fore edge) of the printing medium to form a marking at a side end portion of the printing medium.

SUMMARY OF THE INVENTION

According to a knowledge of the present inventors, it is appropriate that the ink, which forms the marking, is permeated in the thickness direction of the printing medium, wherein it is easy for a user to confirm the marking when the marking is viewed from the side of the printing medium. However, in the case of the ordinary printing, it is enough that the image or the text is printed on only the surface of the printing medium. Therefore, the ink jetting amount is regulated to such an extent that the ink is not permeated into the back surface of the printing medium in order to secure the quality of the printing medium subjected to the printing or suppress the consumption of the ink. Therefore, the ink is not sufficiently permeated in the thickness direction of the printing medium when the ink liquid droplets are jetted onto the surface of the printing medium in order to form the marking in the same manner as in the ordinary printing, as performed by the ink-jet printer described in the foregoing Japanese Patent Application Laid-open No. 2006-56068. Therefore, in the case of the printing medium on which the marking is formed by diverting the borderless printing function which does not aim at the permeation of the ink in the thickness direction of the printing medium, it is extremely difficult for the user to confirm the marking formed by the ink-jet printer when the printing medium is viewed from the side.

In view of the above, an object of the present invention is to provide an ink-jet printer which forms a marking to be easily confirmed from the side of the printing medium.

According to a first aspect of the present invention, there is provided an ink-jet printer which performs printing on a sheet-shaped printing medium, including:

an ink;

an ink tank which stores the ink;

a transport mechanism which transports the printing medium in a predetermined transport direction;

an ink-jet head which faces one surface of the printing medium transported by the transport mechanism and in which a nozzle for jetting ink droplets of the ink supplied from the ink tank toward the printing medium is formed; and a controller which controls the ink-jet head to perform an ordinary jetting operation and a marking jetting operation, the ordinary jetting operation being an operation in which the ink droplets are jetted toward an area of the printing medium, different from an edge portion of the printing medium, and the marking jetting operation being an operation in which the ink droplets are jetted toward a part of the edge portion of the printing medium in an amount greater than that used in the ordinary jetting operation to form a marking at the edge portion.

According to the first aspect of the present invention, the ink, which is landed on the printing medium in the marking jetting operation, is permeated in a larger amount in the thickness direction of the printing medium as compared with the ink which is landed on the printing medium in the ordinary jetting operation. When the marking jetting operation, which is different from the ordinary jetting operation, is executed as described above, it is possible to form the marking which can be easily confirmed from the side of the printing medium.

According to a second aspect of the present invention, there is provided an ink-jet printer which performs printing on a sheet-shaped printing medium, the ink-jet printer including:

inks which include a black pigment-ink and three color dye-inks of magenta, cyan, and yellow;

a plurality of ink tanks which store the black pigment-ink and the color dye-inks respectively;

a transport mechanism which transports the printing medium in a predetermined transport direction;

an ink-jet head which faces one surface of the printing medium transported by the transport mechanism and in which a black-ink nozzle jetting the black pigment-ink toward the printing medium and color-ink nozzles jetting the three color dye-inks respectively, toward the printing medium; and a controller which controls the ink-jet head such that the ink-jet head performs an ordinary jetting operation in which ink droplets are jetted toward an area, of the printing medium, different from an edge portion of the printing medium; such that the ink-jet head performs a marking jetting operation in which ink droplets are jetted toward a part of the edge portion of the printing medium to form a marking; and such that when a black marking is formed in the marking jetting operation, the liquid droplets of the three color dye-inks are jetted from the color-ink nozzles onto the printing medium to overlap with each other at the part of the edge portion.

According to the second aspect of the present invention, when it is required to form the black marking in the marking jetting operation, the dye color inks, which are easily permeated into the printing medium as compared with the pigment black ink, are used. Therefore, even when the total consumption amount of the dye color inks is smaller than the consumption amount of the ink required to form the black marking with only the pigment black ink, the ink liquid droplets can be permeated in the thickness direction of the printing medium.

The marking, which is easily confirmable from the side of the printing medium, can be formed by executing the marking jetting operation which is different from the ordinary jetting operation.

BRIEF DESCRIPTION OF THE DRAWINGS

FIGS. 7A and 7B show schematic plan views illustrating the printing operation on the recording paper by the ink-jet printer according to the first embodiment of the present invention, wherein FIG. 7A shows a situation in which ink liquid droplets are jetted from nozzles, and FIG. 7B shows a situation in which the ink liquid droplets jetted from the nozzles are landed on the recording paper.

FIG. 10A to 10D show schematic sectional views illustrating the printing operation on the recording paper by the ink-jet printer according to the second embodiment of the present invention, wherein FIG. 10A shows a situation in which a solvent is jetted from solvent-jetting nozzles, FIG. 10B shows a situation in which the solvent jetted from the solvent-jetting nozzles is landed on the recording paper, FIG. 10C shows a situation in which ink liquid droplets are jetted from nozzles, and FIG. 10D shows a situation in which the ink liquid droplets jetted from the nozzles are landed on the recording paper.

FIGS. 14A to 14D illustrate transport states of the recording paper in the ink-jet printer according to the fifth embodiment of the present invention, wherein FIG. 14A shows a situation in which the recording paper is fed, FIG. 14B shows a situation in which the printing operation is performed on one surface of the fed recording paper, FIG. 14C shows a situation in which the recording paper having been subjected to the printing operation on one surface is inverted, and FIG. 14D shows a situation in which the printing operation is performed on the other surface of the inverted recording paper.

DESCRIPTION OF THE PREFERRED EMBODIMENTS

First Embodiment

A first embodiment of the present invention will be explained below. An ink-jet printer according to the first embodiment prints, for example, desired letters and/or images on the recording paper by jetting liquid droplets of inks of four colors (cyan, magenta, yellow, and black) onto the sheet-shaped recording paper (printing medium) from nozzles provided for an ink-jet head. The sheet-shaped printing paper includes, for example, thin paper sheets, thick paper sheets, and films.

Figure 1:
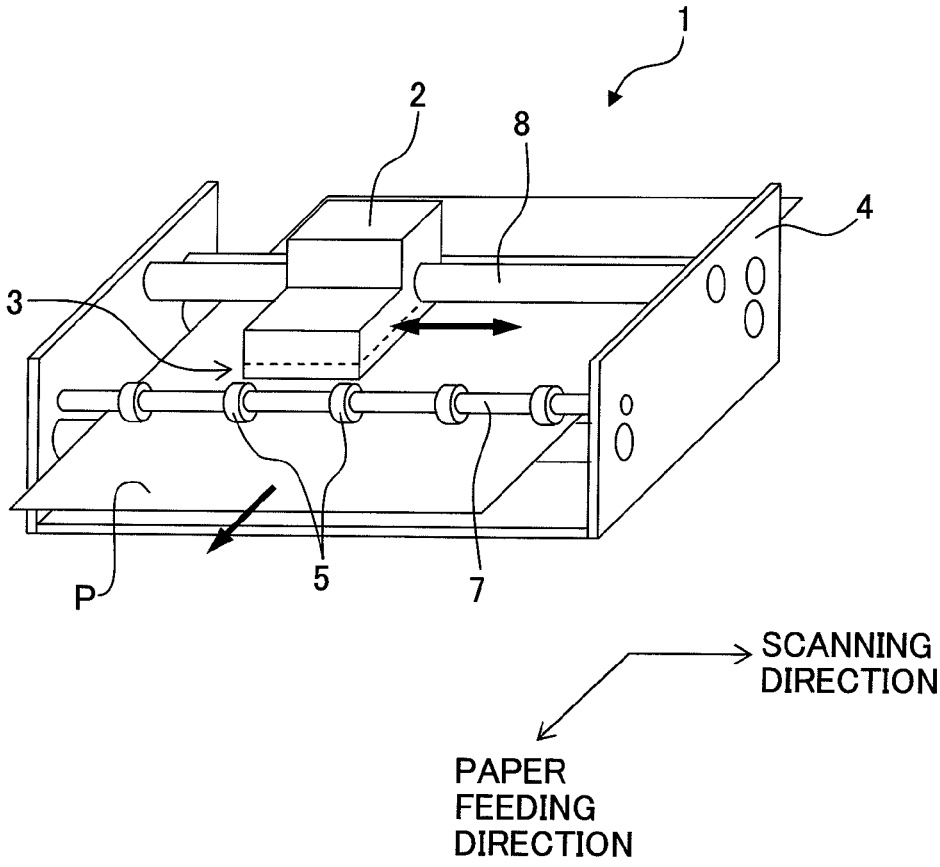
FIG. 1 shows a schematic arrangement of an ink-jet printer according to a first embodiment of the present invention.

At first, the ink-jet printer will be explained. FIG. 1 shows a schematic arrangement of the ink-jet printer according to the first embodiment of the present invention. As shown in FIG. 1, the ink-jet printer 1 includes a carriage 2 which is movable in the left-right direction (scanning direction) as shown in FIG. 1, the ink-jet head 3 of the serial type in which the nozzles 40 are formed (see FIGS. 2 to 4) and which is provided on the carriage 2 to jet the ink liquid droplets with respect to the recording paper P, transport rollers 5 (transport mechanism) which transport the recording paper P in the frontward direction (paper feeding direction: transport direction) as shown in FIG. 1, and a control unit (controller) 6 (see FIG. 5) which controls respective constitutive components of the ink-jet printer 1.

The carriage 2 is provided so that the carriage 2 is reciprocatively movable in the scanning direction along a guide shaft 8 which is arranged to range over two side walls of a frame (main body frame) 4. The carriage 2 is movable in the scanning direction to the area disposed outside the printing paper P (area deviated from the recording paper P as viewed in the ink jetting direction). The ink-jet head 3 is carried on the carriage 2. The ink-jet head 3 jets the ink liquid droplets onto the recording paper P transported by the transport rollers 5, from the nozzles 40 provided on the lower surface of the ink-jet head 3, while making the reciprocating movement in the scanning direction together with the carriage 2.

The transport rollers 5 are fixed to a rotary shaft 7 which is arranged to range over the two side walls of the frame 4. When the rotary shaft 7 is rotated about the center of the axis, then the transport rollers 5 are rotated together with the rotary shaft 7, and the recording paper P is transported in the paper feeding direction.

Figure 2:
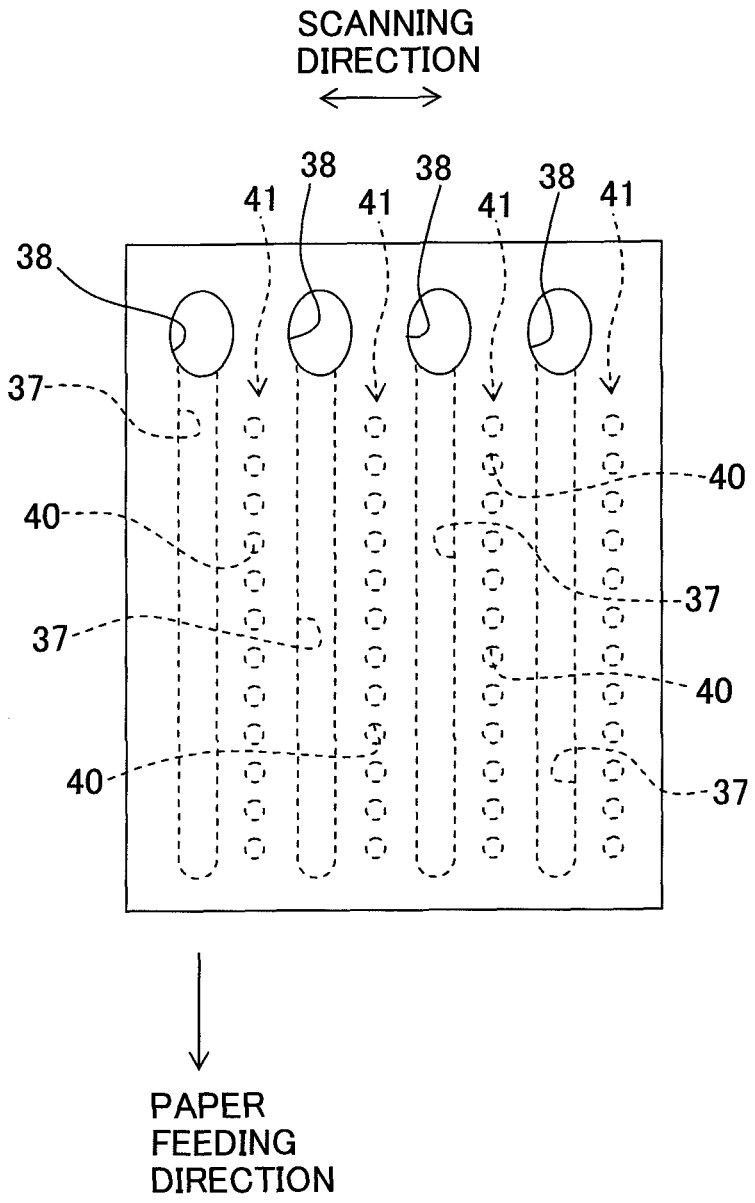
FIG. 2 shows a top view illustrating an ink-jet head.
Figure 3:
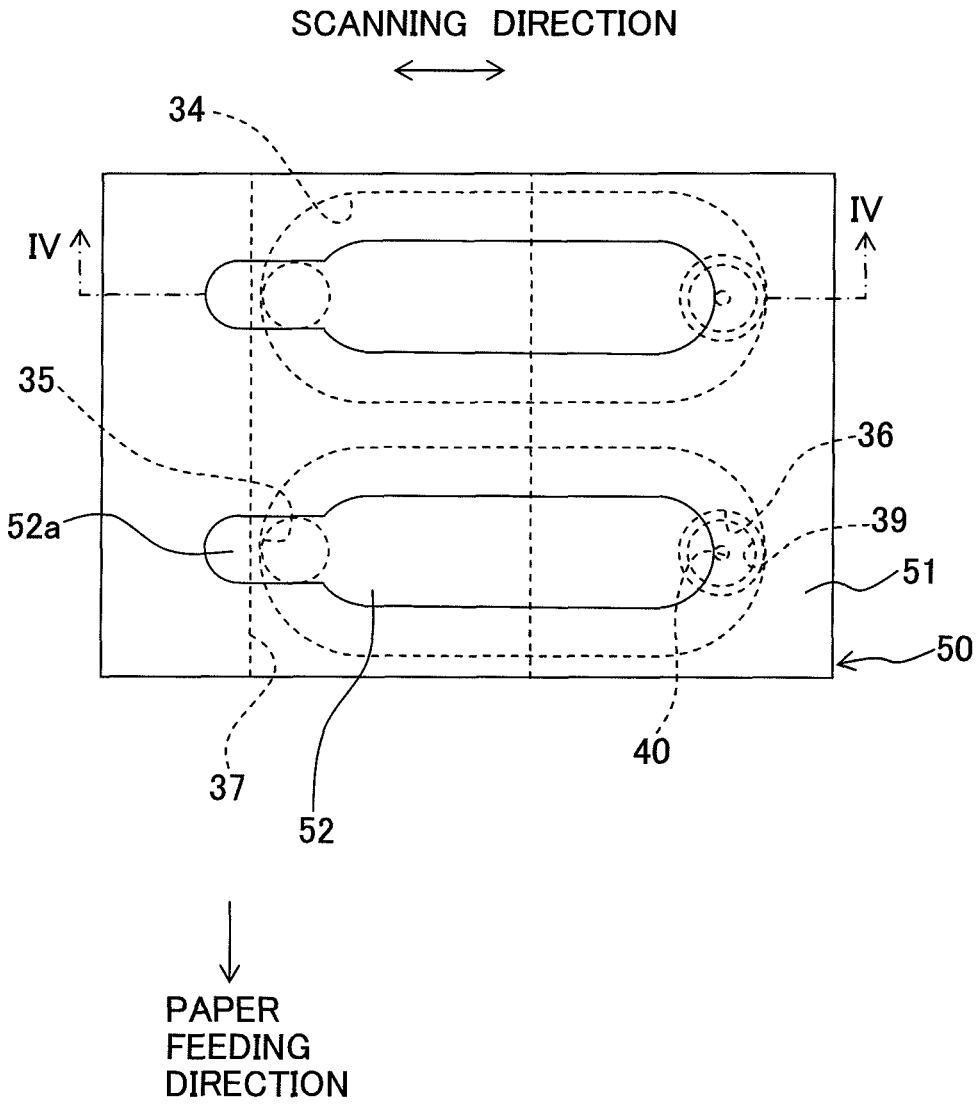
FIG. 3 shows a partial magnified view illustrating those shown in FIG. 2.
Figure 4:
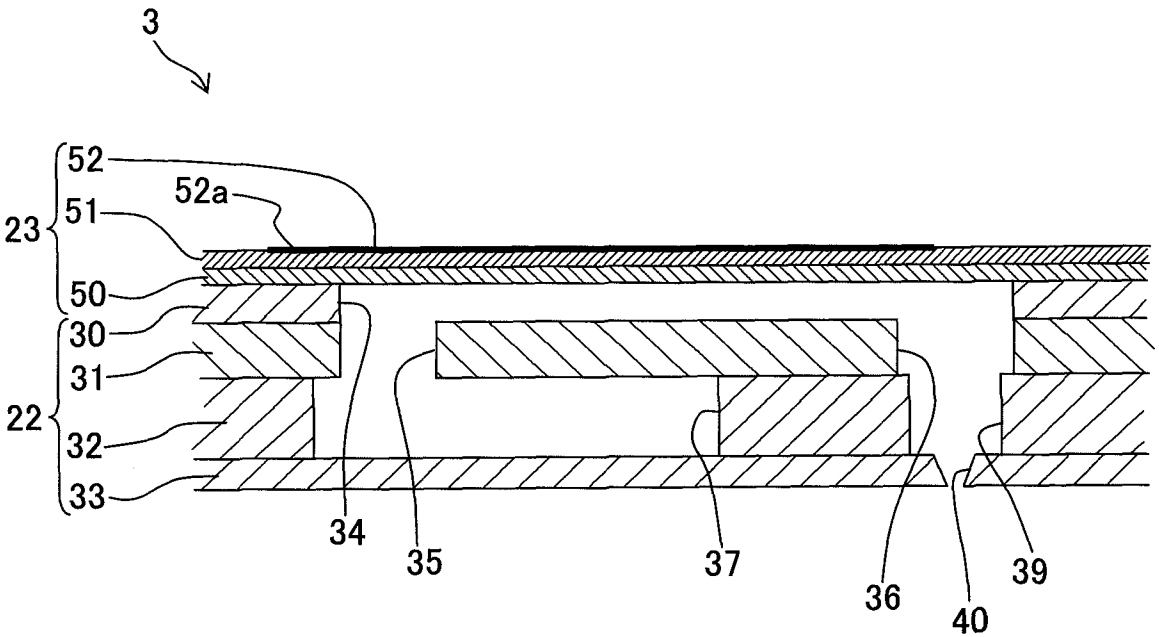
FIG. 4 shows a sectional view taken along a IV-IV line shown in FIG. 3.

Next, the ink-jet head 3 will be explained in detail. FIG. 2 shows a top view illustrating the ink-jet head. FIG. 3 shows a partial magnified view illustrating those shown in FIG. 2. FIG. 4 shows a sectional view taken along a IV-IV line shown in FIG. 3. However, in order to understand the drawings more comprehensively, pressure chambers 34 and through-holes 35, 36, 39, which are depicted in FIG. 3, are omitted from the illustration in FIG. 2, and the nozzles 40 are depicted to be large as compared with FIGS. 3 and 4.

As shown in FIGS. 2 to 4, the ink-jet head 3 has a flow passage unit 22 which is formed with ink flow passages including the nozzles 40 and the pressure chambers 34, and a piezoelectric actuator 23 which jets the ink liquid droplets from the nozzles 40 of the flow passage unit 22 by applying the pressure to the inks contained in the pressure chambers 34.

At first, the flow passage unit 22 will be explained. The flow passage unit 22 has a cavity plate 30, a base plate 31, and a manifold plate 32 each of which is formed of a metal material such as stainless steel, and a nozzle plate 33 which is formed of an isolative material (for example, a high molecular weight synthetic resin material such as polyimide). The four plates 30 to 33 are joined to one another in a stacked state.

The nozzle plate 33 is formed with the plurality of nozzles 40 as through-holes. The plurality of nozzles 40 are arranged in the paper feeding direction (in the upward-downward direction as shown in FIG. 2) to form nozzle arrays 41. The four nozzle arrays 41 as described above are arranged, side by side, in the scanning direction. The inks of four colors of black, yellow, cyan, and magenta are jetted from the nozzles 40 belonging to the four nozzle arrays 41 respectively.

In this embodiment, a pigment ink is used for the black ink, and dye inks are used for the other three color inks of yellow, cyan, and magenta. In the pigment ink, the pigment component is dispersed in a particle form in a solvent without being dissolved in surfactant or water as a solvent. When the pigment ink is jetted from the nozzles 40 onto the recording paper P, then the particles of the pigment component remain on the surface of the recording paper P, and the particles themselves form the color. In the dye ink, the dye component is dissolved in surfactant or water as a solvent. When the dye ink is jetted from the nozzles 40 onto the recording paper P, then the solvent, in which the dye component is dissolved, is permeated into the recording paper P, and thus the color is formed. In general, the dye ink is easily permeated in the thickness direction of the recording paper P as compared with the pigment ink.

As shown in FIGS. 3 and 4, the cavity plate 30 is formed with the plurality of pressure chambers 34 corresponding to the plurality of nozzles 40. Each of the pressure chambers 34 has a substantially elliptic shape in which the scanning direction is the longitudinal direction thereof. The pressure chambers 34 are arranged so that the right ends of the pressure chambers 34 are overlapped with the nozzles 40 as viewed in a plan view. Through-holes 35, 36 are formed at positions of the base plate 31 overlapped with the both ends of the pressure chambers 34 in the longitudinal direction as viewed in a plan view respectively.

Four manifold flow passages 37, which correspond to the four nozzle arrays 41 respectively, are formed for the manifold plate 32. As shown in FIGS. 2 to 4, each of the manifold flow passages 37 extends in the paper feeding direction at the left position of the corresponding nozzle array 41. Further, the manifold flow passage 37 is overlapped with substantially left halves of the corresponding pressure chambers 34 as viewed in a plan view. As shown in FIG. 2, ends of the four manifold flow passages 37 (ends on the upstream side in the paper feeding direction: upper ends as shown in FIG. 2) are communicated with four ink supply ports 38 which are formed for the cavity plate 30 disposed at the uppermost layer respectively. The four ink supply ports 38 are connected to four unillustrated ink tanks respectively. The inks contained in the ink tanks are supplied from the ink supply ports 38 to the manifold flow passages 37. Through-holes 39 are formed at positions of the manifold plate 32 overlapped with both of the through-holes 36 of the base plate 31 and the nozzles 40 of the nozzle plate 33 as viewed in a plan view.

As shown in FIG. 4, the manifold flow passages 37, which are connected to the ink supply ports 38, are communicated with the pressure chambers 34 via the through-holes 35 in the flow passage unit 22. The pressure chambers 34 are further communicated with the nozzles 40 via the through-holes 36, 39. In other words, the flow passage unit 22 is formed with a plurality of individual ink flow passages which range from the outlets of the manifold flow passages 37 to arrive at the nozzles 40 via the pressure chambers 34.

Next, the piezoelectric actuator 23 will be explained. The piezoelectric actuator 23 has a vibration plate 50, a piezoelectric layer 51, and a plurality of individual electrodes 52. The vibration plate 50 is composed of a conductive material such as a metal material. The vibration plate 50 is joined to the upper surface of the cavity plate 30 so that the plurality of pressure chambers 34 are covered therewith. The conductive vibration plate 50 also serves as a common electrode to allow the electric field to act on the portions of the piezoelectric layer 51 interposed between the vibration plate 50 and the plurality of individual electrodes 52 as described later on. The vibration plate 50 is connected to the ground wiring of a head driver 54 (see FIG. 5), and the vibration plate 50 is always retained at the ground electric potential.

The piezoelectric layer 51 is composed of a piezoelectric material containing a main component of lead titanate zirconate (PZT) having the ferroelectric property as a mixed crystal of lead titanate and lead zirconate. The piezoelectric layer 51 is arranged continuously to range over the plurality of pressure chambers 34 on the upper surface of the vibration plate 50. The piezoelectric layer 51 is previously polarized in the thickness direction thereof.

The plurality of individual electrodes 52 are provided corresponding to the plurality of pressure chambers 34 on the upper surface of the piezoelectric layer 51. The individual electrode 52 has a substantially elliptic shape which is one size smaller than the pressure chamber 34. The individual electrodes 52 are arranged at positions overlapped with substantially central portions of the pressure chambers 34 as viewed in a plan view. One end of each of the individual electrodes 52 in the longitudinal direction (left end as shown in FIG. 3) extends leftwardly to a position not overlapped with the pressure chamber 24 as viewed in a plan view. The forward end thereof is a contact 52*a*. The head driver 54 is connected to the contact 52*a* via a wiring member such as an unillustrated flexible printed circuit (FPC). Any one of electric potentials of a predetermined driving electric potential and the ground electric potential is selectively applied from the head driver 54 to the plurality of individual electrodes 52.

An explanation will be made about the function of the piezoelectric actuator 23 having the feature as described above. When the pressure is not applied to the ink (when the ink liquid droplets are not jetted from the nozzles 40), the electric potentials of the plurality of individual electrodes 52 are previously retained at the ground electric potential by the head driver 54. Starting from this state, when the predetermined driving electric potential is applied to any one of the plurality of individual electrodes 52 by the head driver 54, then the electric potential difference is generated between the individual electrode 52 to which the driving electric potential is applied and the vibration plate 50 as the common electrode which is retained at the ground electric potential, and the electric field is generated in the thickness direction at the portion of the piezoelectric layer 51 interposed between the individual electrode 52 and the vibration plate 50. In this situation, when the direction of polarization of the piezoelectric layer 51 is the same as the direction of the electric field, then the piezoelectric layer 51 is elongated in the thickness direction, and the piezoelectric layer 51 is shrunk in the in-plane direction. The portion of the vibration plate 50, which is opposed to the pressure chamber 34, is deformed so that the portion protrudes toward the pressure chamber 34 (unimorph deformation) in accordance with the shrinkage deformation of the piezoelectric layer 51. In this situation, the volume of the pressure chamber 34 is decreased. Therefore, the pressure of the ink contained therein is raised, and the ink liquid droplets are jetted from the nozzle 40 communicated with the pressure chamber 34.

In the arrangement as described above, the ink-jet printer 1 performs the following two operations while reciprocatively moving the ink-jet head 3 in the scanning direction together with the carriage 2. At first, in the ordinary jetting operation, the ink-jet head 3 jets the ink liquid droplets onto an area Pb (hereinafter referred to as "printing area Pb") except for an edge portion Pa on the surface of the recording paper P. Further, in the marking jetting operation, the ink-jet head 3 jets the ink liquid droplets onto the edge portion Pa of the recording paper P. Accordingly, for example, images and/or letters are printed on the printing area Pb of the recording paper P, and the marking is formed at a side end portion Pc as the end surface of the recording paper P (see FIG. 6).

Figure 5:
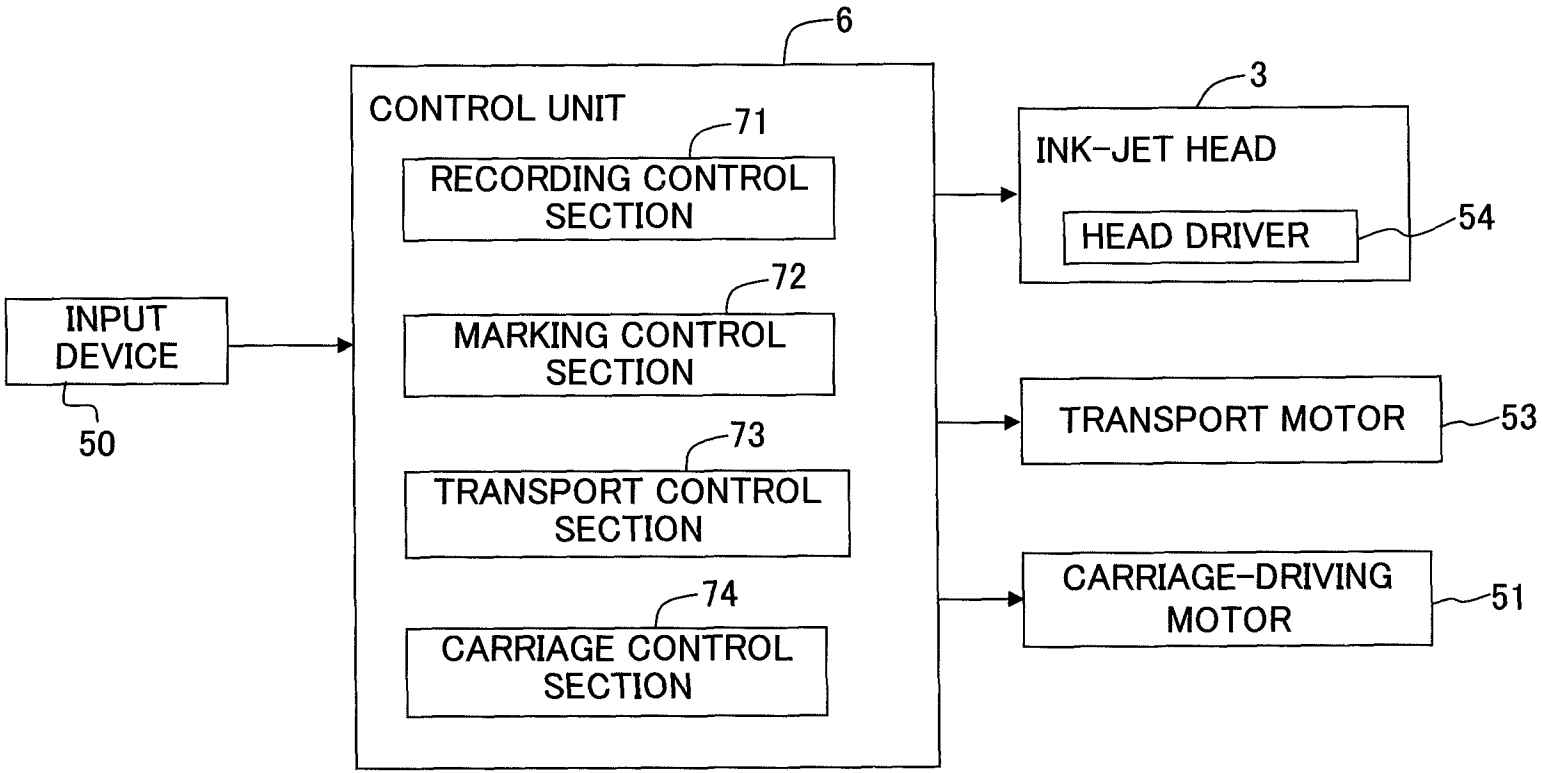
FIG. 5 shows a block diagram illustrating an electric arrangement of the ink-jet printer.
Figure 6:
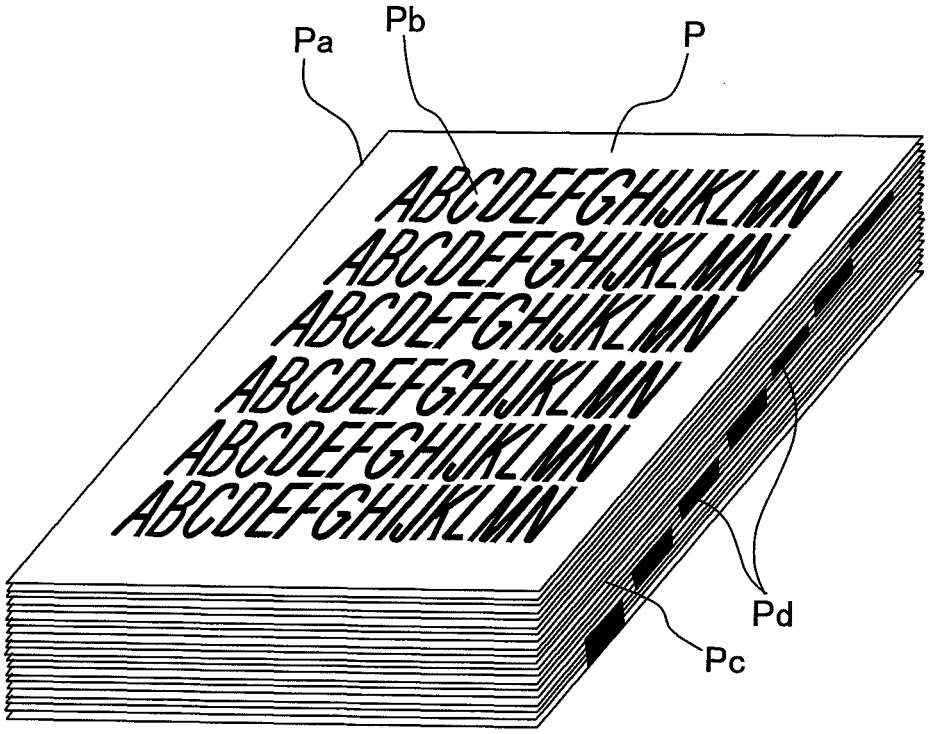
FIG. 6 shows a perspective view illustrating a plurality of stacked printing paper sheets.

Next, an explanation will be made about the control unit 6 which manages the overall control of the ink-jet printer 1. FIG. 5 shows a block diagram illustrating the electric arrangement of the ink-jet printer. FIG. 6 shows a perspective view illustrating a plurality of stacked printing paper sheets.

As shown in FIG. 5, the control unit 6 (control mechanism) comprises, for example, Central Processing Unit (CPU) which serves as the central processing unit, Read Only Memory (ROM) which stores, for example, various programs and data for controlling the overall operation of the ink-jet printer 1, and Random Access Memory (RAM) which temporarily stores, for example, data to be processed by CPU.

Further, the control unit 6 functions as a recording control section 71, a marking control section 72, a transport control section 73, and a carriage control section 74. The recording control section 71 controls the head driver 54 of the ink-jet head 3 on the basis of the data inputted from an input device 50 such as PC to perform the ordinary jetting operation such that the ink liquid droplets are jetted from the nozzles 40 onto the printing area Pb of the recording paper P. The marking control section 72 controls the head driver 54 of the ink-jet head 3 on the basis of the data inputted from the input device 50 such as PC to perform the marking jetting operation such that the ink liquid droplets are jetted from the nozzles 40 onto the edge portion Pa of the recording paper P.

The transport control section 73 controls the transport motor 53 for driving and rotating the transport rollers 5 by the aid of the rotary shaft 7 so that the transport rollers 5 are rotated, and thus the recording paper P is transported in the paper feeding direction. The carriage control section 74 controls the carriage-driving motor 51 so that the carriage 2 is reciprocatively driven in the scanning direction.

Figure 7A:
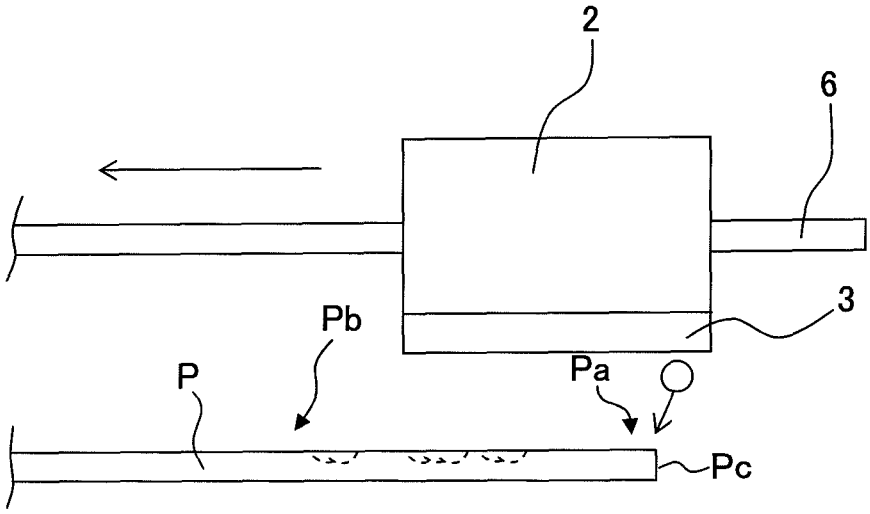
Figure 7B:
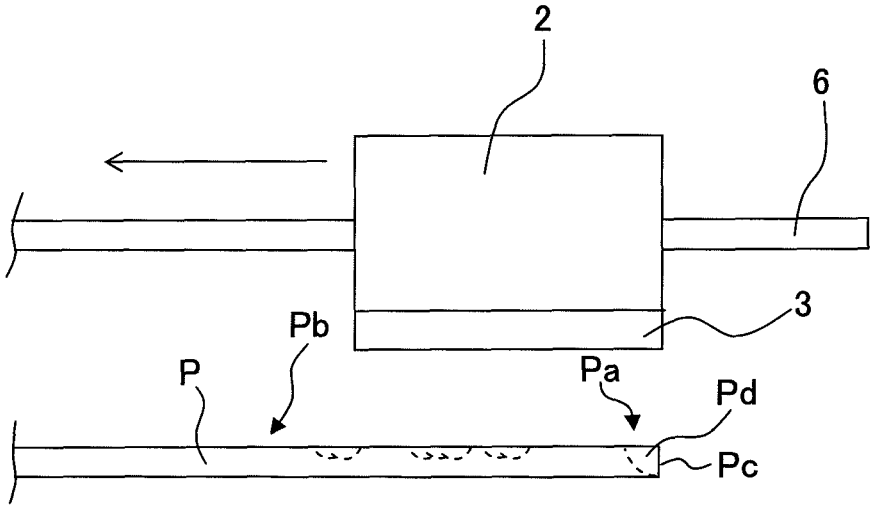
Figure 8:
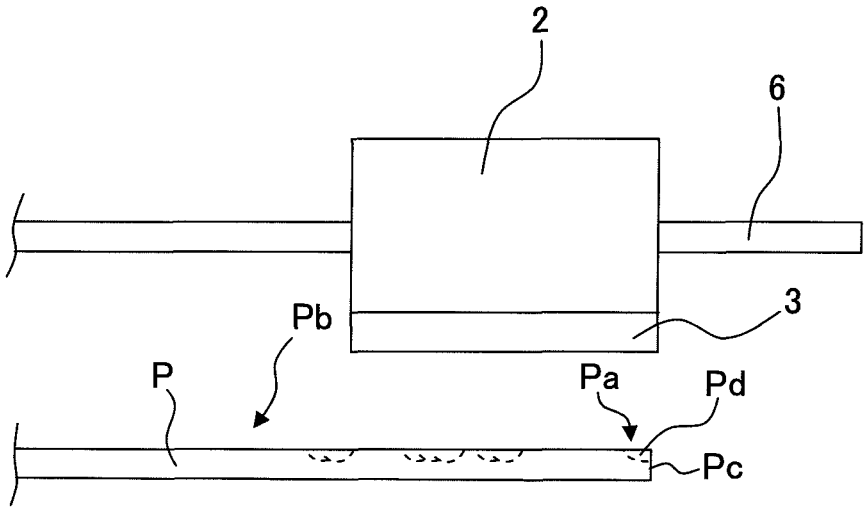
FIG. 8 shows a schematic plan view illustrating the printing operation on the recording paper by a conventional ink-jet printer.

An explanation will now be made about the printing operation performed by the ink-jet printer 1. FIGS. 7A, 7B show schematic cross-sectional views illustrating the printing operation on the recording paper by the ink-jet printer according to the first embodiment of the present invention, wherein FIG. 7A shows a situation in which the ink droplets are jetted from the nozzles, and FIG. 7B shows a situation in which the ink droplets jetted from the nozzles are landed on the recording paper. FIG. 8 shows a schematic cross-sectional view illustrating the printing operation on the recording paper by a conventional ink-jet printer.

At first, the printing data is fed from the input device 50 to the control unit 6 of the ink-jet printer 1. Accordingly, in the ink-jet printer 1, the transport control section 73 controls the transport motor 53 on the basis of the printing data to rotate the transport rollers 5. Accordingly, the recording paper P is intermittently transported by every one line in the paper feeding direction, while the carriage-driving motor 51 is controlled by the carriage control section 74 to reciprocatively drive the carriage 2 in the scanning direction. Simultaneously therewith, the recording control section 71 controls the head driver 54 to perform the printing in an amount corresponding to one line from the nozzles 40 as the ordinary jetting operation.

The printing data, which is inputted from the input device 50, includes the position data of the side end portion Pc of the recording paper P for forming the marking. The position data of the side end portion Pc includes, for example, the information regarding the position of the side end portion Pc in the paper feeding direction, and the information about which end, of the recording paper P in the paper feeding direction, the side end portion Pc is provided at. When the marking Pd is formed at any side end portion Pc, of the both side end portions Pc, overlapped in the scanning direction with the line on the recording paper P on which the ordinary jetting operation is performed, the head driver 54 is controlled by the marking control section 72 to jet the ink droplets from the nozzles 40 capable of jetting the desired color as the marking jetting operation for the nearest edge portion Pa overlapped in the scanning direction with the side end portion Pc of the recording paper P.

As shown in FIG. 7A, in the marking jetting operation, when the ink-jet head 3 is moved toward the recording paper P from the outside thereof in the scanning direction (from the right to the left in FIG. 7A), i.e., when the nozzle 40, which is capable of jetting the desired color, is moved toward the recording paper P from the outside thereof, then the control unit 6 controls the head driver 54 to jet the ink droplets from the nozzle 40 toward the edge portion Pa of the recording paper P. In other words, after the ink-jet head 3 mounted on the carriage 2 is moved rightward in FIG. 7A to the outside of the recording paper P, the ink-jet head 3 is turned and moved leftward. Then the control unit 6 controls the head driver 54 to jet the ink droplets from the nozzle 40. Accordingly, the ink droplets, which are jetted from the nozzle 40, have the velocity component in the direction to approach the recording paper P.

Therefore, the ink droplets are allowed to fall while being inclined in the direction to approach the recording paper P with respect to the vertical direction (upward-downward direction in FIG. 7), and the ink droplets are landed on the side end portion Pc and/or the edge portion Pa of the recording paper P. In other words, the range, in which the ink droplets jetted from the nozzle 40 to form the marking can be landed, is widened, and the landing accuracy is improved.

The jetting of the ink in the printing area and the jetting of the ink to form the marking Pd at the edge portion may be performed in one time of the scanning operation (in a same one-way scanning), or they may be performed in the distinct scanning operations. In other words, a separate scanning, which is to be performed in order to form the marking Pd at the edge portion, may be performed independently from the ordinary scanning. For example, when the two-way printing is performed to jet the inks while reciprocatively moving the ink-jet head 3 in the left-right direction in FIG. 7, then the formation of the marking Pd and the printing on the printing area Pb may be performed in the scanning in one route (scanning directed from the right to the left), and only the printing on the printing area Pb may be performed in the scanning in the return route (scanning directed from the left to the right). In this procedure, after completing the scanning in the return route, the ink-jet head 3 may be further subjected to a short scanning from the right to the left in order to form the marking Pd before proceeding to the next scanning in the one route. In this case, it is not necessarily indispensable that the ink-jet head 3 is subjected to the scanning to cover the entire recording paper P in the widthwise direction thereof. It is enough that the ink-jet head 3 is subjected to the scanning to cover only the edge portion Pa of the recording paper P at which the marking Pd is formed.

A larger amount of the ink is permeated into the area of the recording paper P in which the marking Pd is formed as compared with the area in which the inks are jetted in the printing area as described later on. Therefore, the period of time, which is required to dry the ink in the area formed with the marking Pd, is longer than the period of time which is required to dry the inks in the printing area. Accordingly, when the marking Pd is formed on the recording paper P in the certain scanning, a period of time may be allowed to elapse to some extent before moving the recording paper P in the transport direction in order to proceed to the next scanning. In this case, the process may wait for a certain period of time in a state in which the ink-jet head 3 is stand still, or the process may wait for a certain period of time in a state in which the ink-jet head 3 is subjected to the scanning. When the ink-jet head 3 is subjected to the scanning, then the inks may be jetted only in the printing area, or the empty scanning may be performed without jetting the inks. In any case, when the ink-jet head 3 is subjected to the scanning, the flow of the air arises. Therefore, the ink, which is in the area formed with the marking Pd, can be quickly dried.

As shown in FIG. 8, when the jetting amount of the ink droplets per unit area or areal size, i.e., per one dot subjected to the jetting from the nozzle 40 onto the recording paper P (ink landing amount per one dot of the recording paper P) is equivalent between the ordinary jetting operation and the marking jetting operation, then the degree of permeation in the thickness direction of the ink for forming the marking Pd into the recording paper P is low, and it is extremely difficult to visually confirm the marking Pd, when the marking Pd, which is formed with the concerning ink landing amount, is visually confirmed from the side of the recording paper P (in the left direction in FIG. 8).

Accordingly, in this embodiment, the control unit 6 controls the head driver 54 of the ink-jet head 3 so that the jetting amount (landing amount) of the ink droplets per unit area onto the recording paper P in the marking jetting operation is larger than the jetting amount (landing amount) of the ink liquid droplets per unit area onto the recording paper P in the ordinary jetting operation.

Specifically, the control unit 6 controls the head driver 54 so that the liquid droplets, which have larger volumes, are jetted from the nozzle 40 in the marking jetting operation as compared with the ordinary jetting operation. Accordingly, as shown in FIG. 7B, the ink droplets can be more permeated in the thickness direction of the recording paper P in the marking jetting operation as compared with the ordinary jetting operation. In other words, it is possible to form the marking Pd which can be easily confirmed from the side of the recording paper P.

In order that the jetting amount of the ink droplets per unit area onto the recording paper P in the marking jetting operation is larger than the jetting amount of the ink liquid droplets per unit area onto the recording paper P in the ordinary jetting operation, the following technique is also available, without being limited to only the technique in which the control unit 6 controls the head driver 54 to jet the liquid droplets having the larger liquid droplet volumes from the nozzle 40 in the marking jetting operation as compared with the ordinary jetting operation.

For example, the control unit 6 may control the ink-jet head 3 so that the number of times of jetting of the ink droplets per unit area onto the recording paper P in the marking jetting operation is larger than the number of times of jetting of the ink droplets per unit area onto the recording paper P in the ordinary jetting operation. Accordingly, the ink droplets can be more permeated in the thickness direction of the recording paper P by jetting the ink droplets having the sizes used in the ordinary jetting operation from the nozzle 40, without jetting the large ink droplets not used in the ordinary jetting operation from the nozzle 40 in order to perform the marking jetting operation.

When it is required to form the black marking Pd at the edge portion Pa of the recording paper P in the marking jetting operation, the control unit 6 controls the head driver 54 so that the three color inks in the same amount are jetted in an overlapped or superimposed manner onto the recording paper P from the nozzles 40 for jetting the inks of yellow, cyan, and magenta as the dye inks respectively. Accordingly, the black (so-called tri-color black) marking Pd is appropriately formed as well. As described above, when it is required to form the black marking Pd, the tri-color black is used with the dye color inks which are easily permeated into the recording paper P as compared with the pigment black ink. Therefore, even when the total consumption amount of the dye color inks is smaller than the ink consumption amount required to form the black marking Pd with only the pigment black ink, the ink liquid droplets can be permeated into the thickness direction of the recording paper P. In another case, even when the printing is performed with the dye black ink on the printing area Pb of the recording paper P, the black (so-called tri-color black) marking Pd may be formed by jetting the same amount of the inks of yellow, cyan, and magenta as the dye inks respectively in an overlapped manner onto the edge portion Pa. In this procedure, the control can be made such that the ink amount per one dot is larger when the three type of the dye inks are jetted onto the edge portion Pa as compared with when the dye black ink is jetted onto the printing area Pb. When the control is performed as described above, the ink amount permeated in the thickness direction of the recording paper at the edge portion Pa is larger than the ink amount permeated in the thickness direction of the recording paper at the printing area Pb. Accordingly, it is possible to form the marking Pd which can be easily confirmed from the side of the recording paper P.

As described above, in the case of the ink-jet printer 1 of the embodiment of the present invention, the ink droplets, which are jetted onto the recording paper P in the marking jetting operation, are more permeated in the thickness direction of the recording paper P as compared with the ink liquid droplets which are jetted onto the recording paper P in the ordinary jetting operation. In this way, when the marking jetting operation, which is different from the ordinary jetting operation, is executed, it is possible to form the marking Pd which can be easily confirmed from the side of the recording paper P. The moving mechanism of the present invention corresponds to the structure in which the carriage control section 74 controls the carriage-driving motor 51 to move the carriage 2 mounting the ink-jet head 3.

Second Embodiment

Figure 9:
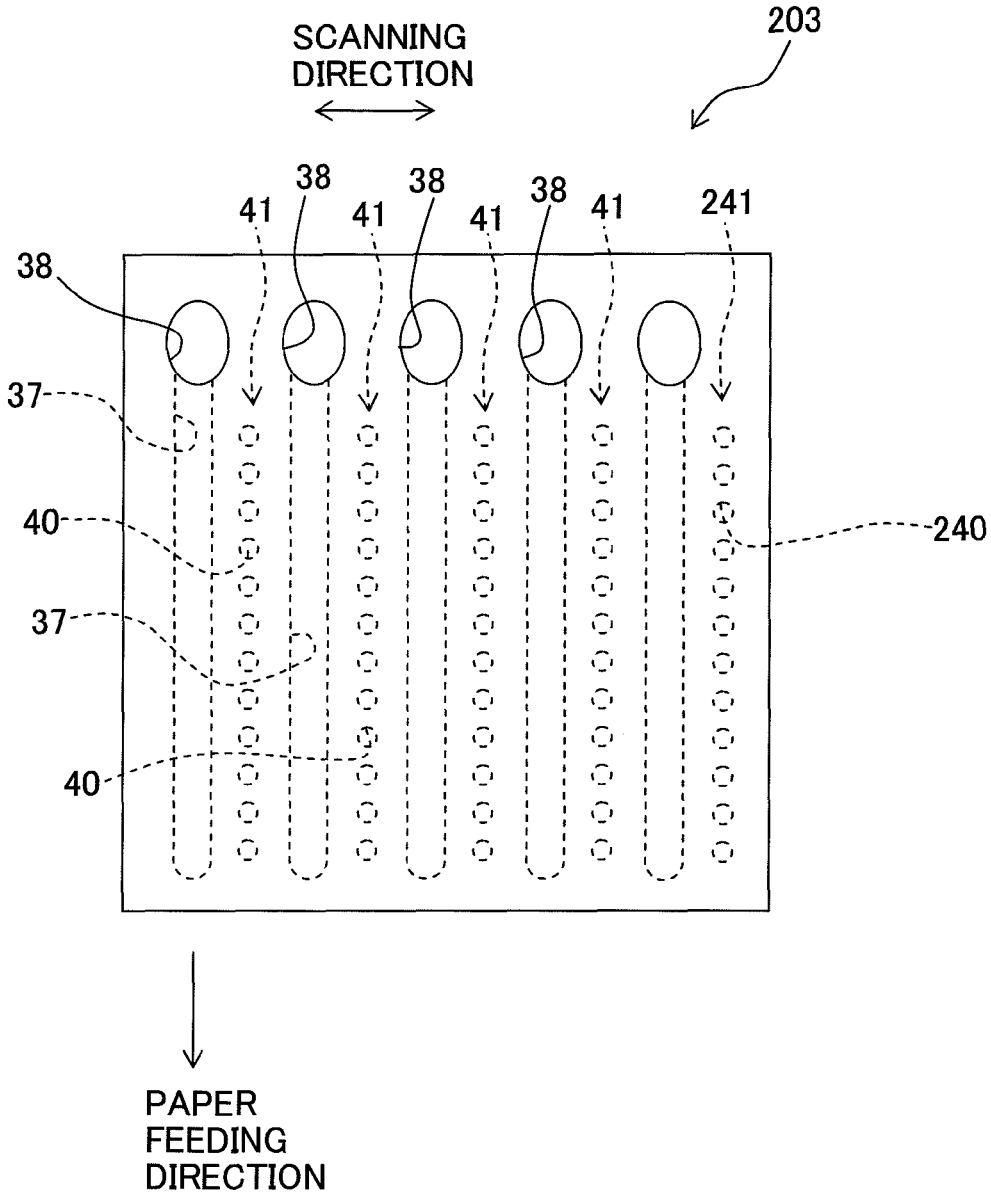
FIG. 9 shows a top view illustrating an ink-jet head according to a second embodiment of the present invention.
Figure 10A:
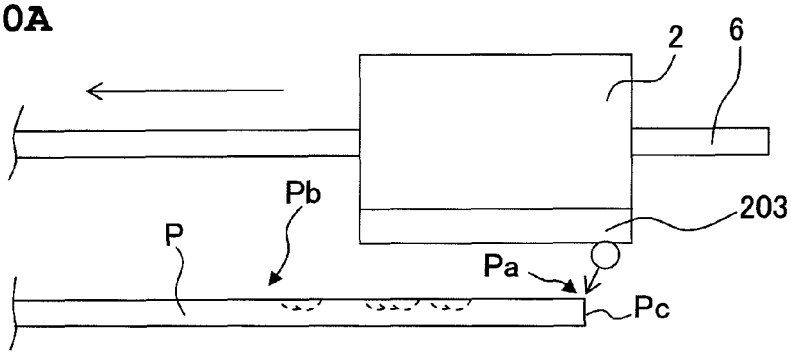
Figure 10B:
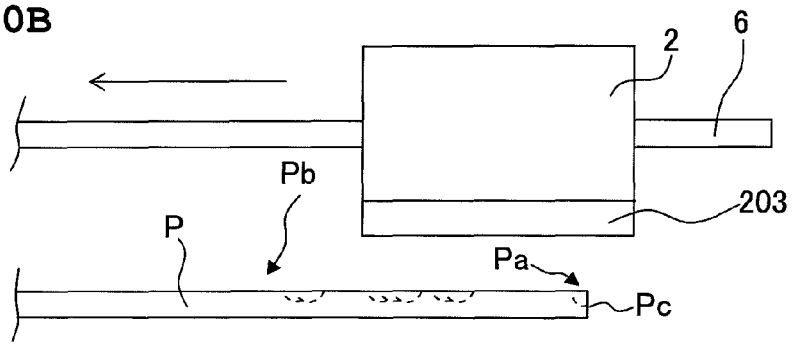
Figure 10C:
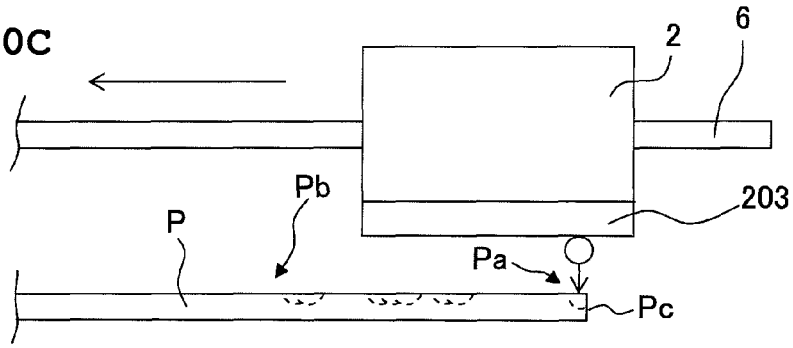
Figure 10D:
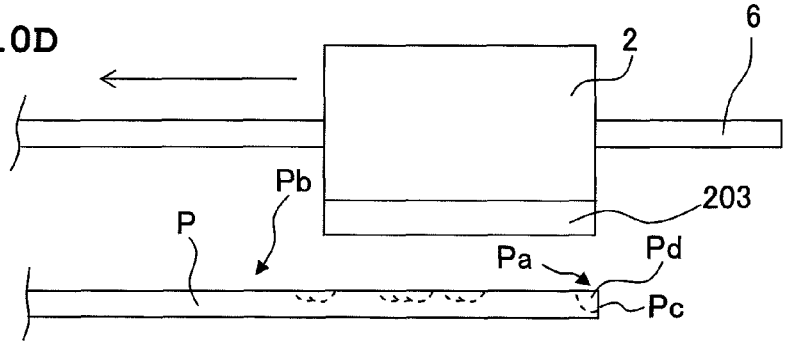

Next, a second embodiment of the present invention will be explained. FIG. 9 shows a top view illustrating an ink-jet head according to the second embodiment of the present invention. FIG. 10A to 10D show schematic plan views illustrating the printing operation on the recording paper by the ink-jet printer according to the second embodiment of the present invention, wherein FIG. 10A shows a situation in which a solvent is jetted from solvent-jetting nozzles, FIG. 10B shows a situation in which the solvent jetted from the solvent-jetting nozzles is landed on the recording paper, FIG. 10C shows a situation in which ink droplets are jetted from nozzles, and FIG. 10D shows a situation in which the ink droplets jetted from the nozzles are landed on the recording paper.

In the ink-jet printer of this embodiment, the ink-jet head 3 of the first embodiment is merely additionally provided with the plurality of solvent-jetting nozzles which jet the solvent to enhance the degree of permeation of the ink into the recording paper P. The other components or parts are constructed in the same manner as in the first embodiment. The components or parts, which are the same as or equivalent to those of the first embodiment, are designated by the same reference numerals, any explanation of which will be omitted.

As shown in FIG. 9, the ink-jet head 203 has the plurality of solvent-jetting nozzles 240 which are aligned in the paper feeding direction (in the upward-downward direction as shown in FIG. 9) on the right side in FIG. 9 and which form a nozzle array 241, in addition to the plurality of nozzles 40 which constitute the four nozzle arrays 41. The nozzle array 241 is arranged, side by side, in the scanning direction together with the four nozzle arrays 41. The solvent, which is jetted from the solvent-jetting nozzles 240, includes, for example, glycol ethers represented by alkyl ethers such as ethylene glycol system and propylene glycol system.

An explanation will now be made about the marking jetting operation performed by the ink-jet printer according to this embodiment. At first, as shown in FIG. 10A, the control unit 6 controls the head driver 54 so that the solvent is jetted from the solvent-jetting nozzles 240 toward the edge portion Pa of the recording paper P. Accordingly, as shown in FIG. 10B, the solvent, which is landed on the edge portion Pa of the recording paper P, is permeated in the thickness direction of the edge portion Pa of the recording paper P.

After that, as shown in FIG. 10C, the control unit 6 controls the head driver 54 so that the ink droplets are jetted from the nozzle 40 onto the landing position which is the same position as that of the edge portion Pa of the recording paper P on which the solvent has been landed. Accordingly, as shown in FIG. 10D, the ink droplets, which are jetted from the nozzle 40, are landed on the same position, of the edge portion Pa of the recording paper P, onto which the solvent has been jetted. The ink droplets are permeated in the thickness direction of the recording paper P in accordance with the action of the solvent to form the marking Pd, as compared with a case in which the ink droplets are landed on the recording paper P into which the solvent is not permeated. In this embodiment, the marking jetting operation is the series of operations in which the control unit 6 controls the head driver 54 to jet the solvent from the solvent-jetting nozzles 240 onto the edge portion Pa of the recording paper P, and then the ink droplets are jetted from the nozzles 40 onto the same position, of the edge portion Pa of the recording paper P, onto which the solvent has been jetted from the solvent-jetting nozzles 240.

Accordingly, the ink droplets, which are jetted onto the recording paper P in the marking jetting operation, can be more permeated in the thickness direction of the recording paper P, as compared with the ink droplets which are jetted onto the recording paper P in the ordinary jetting operation. Therefore, it is possible to form the marking Pd which can be easily confirmed from the side of the recording paper P.

Third Embodiment

Figure 11:
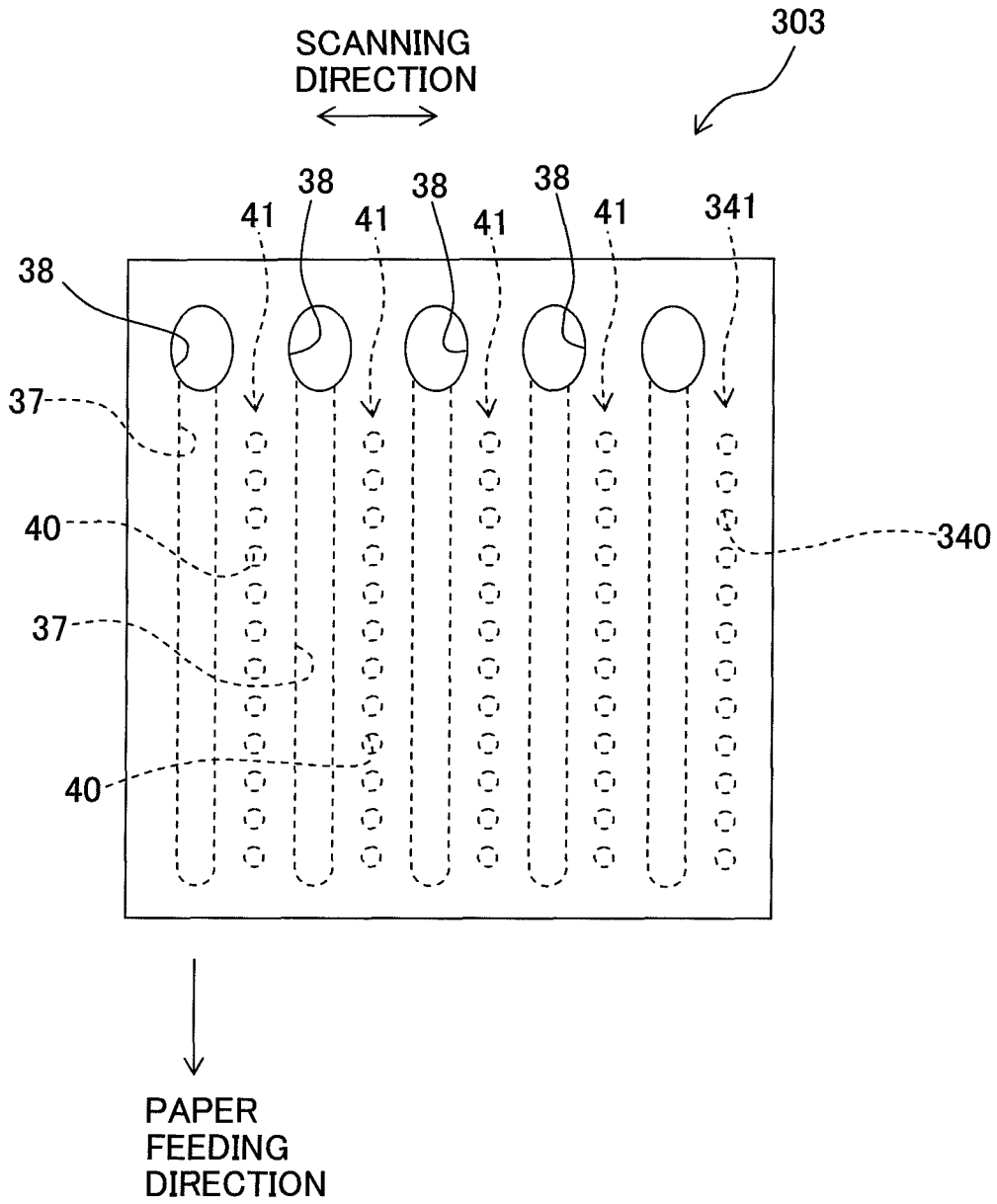
FIG. 11 shows a top view illustrating an ink-jet head according to a third embodiment of the present invention.

Next, a third embodiment of the present invention will be explained. FIG. 11 shows a top view illustrating an ink-jet head according to the third embodiment of the present invention. In an ink-jet printer of this embodiment, the ink-jet head 3 of the first embodiment is merely additionally provided with marking ink-jetting nozzles for jetting a marking ink. The other components or parts are constructed in the same manner as in the first embodiment. The components or parts, which are the same as or equivalent to those of the first embodiment, are designated by the same reference numerals, any explanation of which will be omitted.

As shown in FIG. 11, the ink-jet head 303 has the plurality of marking ink-jetting nozzles 340 which are aligned in the paper feeding direction (in the upward-downward direction as shown in FIG. 11) on the right side in FIG. 11 and which form a nozzle array 341, as well as the plurality of nozzles 40 which constitute the four nozzle arrays 41. The nozzle array 341 is arranged, side by side, in the scanning direction together with the four nozzle arrays 41. The marking ink, which is jetted from the marking ink-jetting nozzles 340, is an ink to be exclusively used for the marking as prepared by mixing the ink to be used for the ordinary jetting operation such as the ink jetted from the nozzles 40 and a solvent to enhance the degree of permeation of the ink into the recording paper P.

In the marking jetting operation performed by the ink-jet printer according to this embodiment, the control unit 6 controls the head driver 54 so that the marking ink is jetted from the marking ink-jetting nozzles 340 toward the edge portion Pa of the recording paper P. Accordingly, the marking ink, which is landed on the edge portion Pa of the recording paper P, is more permeated in the thickness direction of the edge portion Pa of the recording paper P, as compared with a case in which the ink jetted from the nozzle 40 is landed on the recording paper P in the ordinary jetting operation. Accordingly, the liquid droplets of the marking ink, which are jetted onto the recording paper P in the marking jetting operation, can be more permeated in the thickness direction of the recording paper P, as compared with the droplets of the ink which are jetted onto the recording paper P in the ordinary jetting operation. In other words, it is possible to form the marking Pd which can be easily confirmed from the side of the recording paper P. Further, it is possible to suppress the amount of consumption of the ink for the ordinary jetting operation, as compared with a case in which the same ink is used for both of the ordinary jetting operation and the marking jetting operation.

Fourth Embodiment

Figure 12:
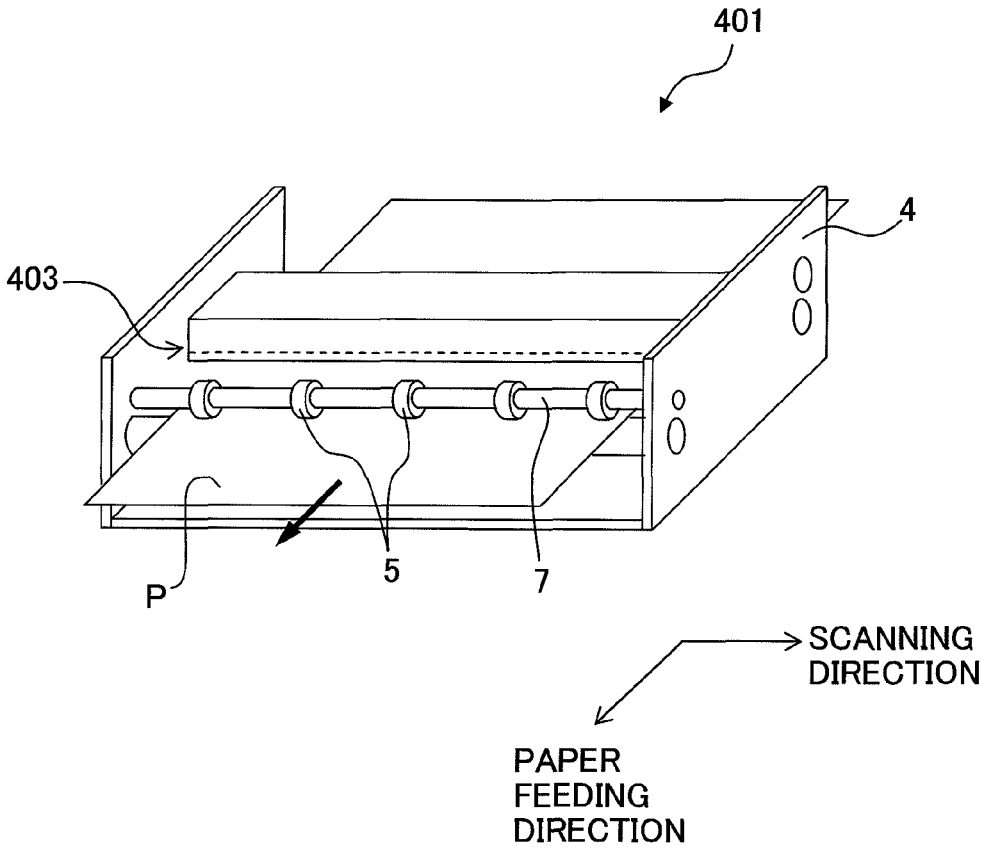
FIG. 12 shows a schematic arrangement of an ink-jet printer according to a fourth embodiment of the present invention.

Next, a fourth embodiment of the present invention will be explained. FIG. 12 shows a schematic arrangement of an ink-jet printer according to the fourth embodiment of the present invention. As shown in FIG. 12, an ink-jet head 403 of this embodiment is a line type ink-jet head. The ink-jet head 403 has a plurality of unillustrated nozzles which are arranged in the scanning direction (left-right direction as shown in FIG. 12) on the lower surface thereof to range over the entire region in the scanning direction of the printing paper. Further, the ink-jet head 403 is constructed such that the ink droplets are jetted from the plurality of nozzles onto the recording paper P in a state of being positioned and fixed to the frame 4 at a predetermined liquid droplet-jetting position. The plurality of nozzles are aligned in the scanning direction to form four nozzle arrays. The four nozzle arrays are arranged, side by side, in the paper feeding direction (upward-downward direction in FIG. 12). The four color inks of black, yellow, cyan, and magenta are jetted from the nozzles belonging to the four nozzle arrays respectively.

In the marking jetting operation performed by the ink-jet printer 401 according to this embodiment, the ink droplets are jetted from the nozzles facing the edge portion Pa of the recording paper P transported by the transport rollers 5, and the marking Pd is formed at the side end portion Pc of the recording paper P. In other words, the nozzles, which are opposed to the edge portion Pa of the recording paper P transported by the transport rollers 5, are exclusively used for the marking jetting operation.

Fifth Embodiment

Figure 13:
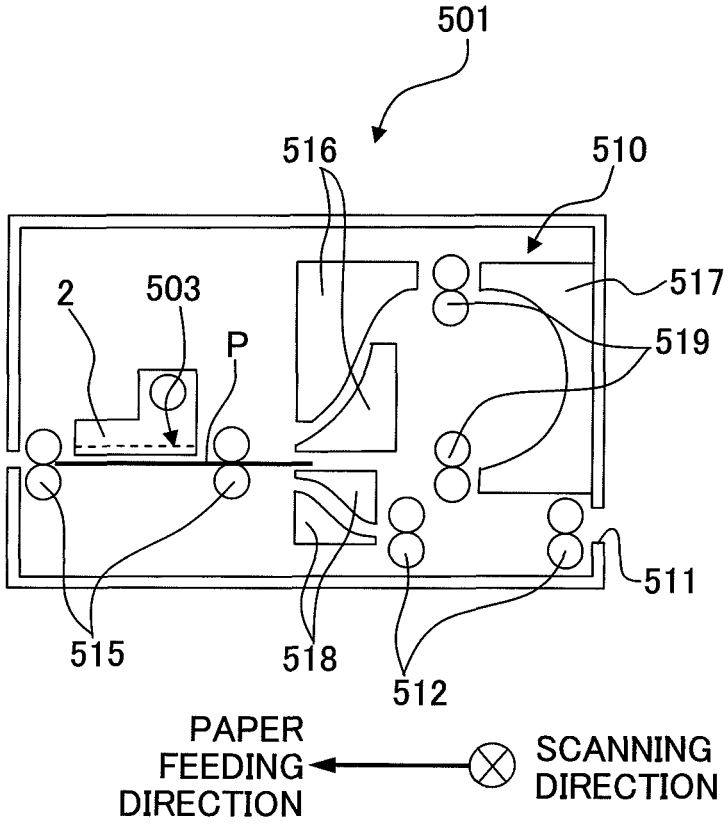
FIG. 13 shows a schematic sectional view illustrating an ink-jet printer according to a fifth embodiment of the present invention.
Figure 14A:
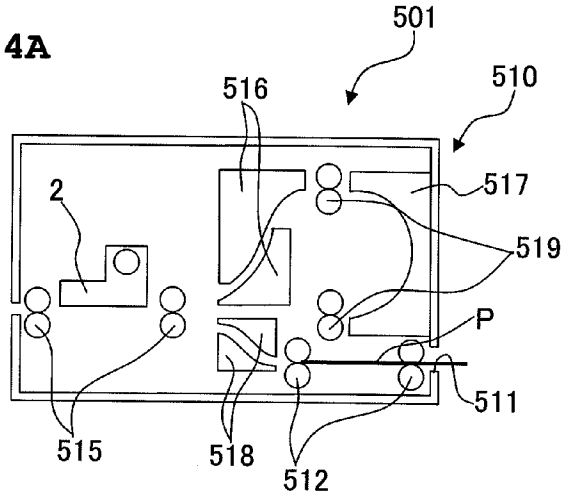
Figure 14B:
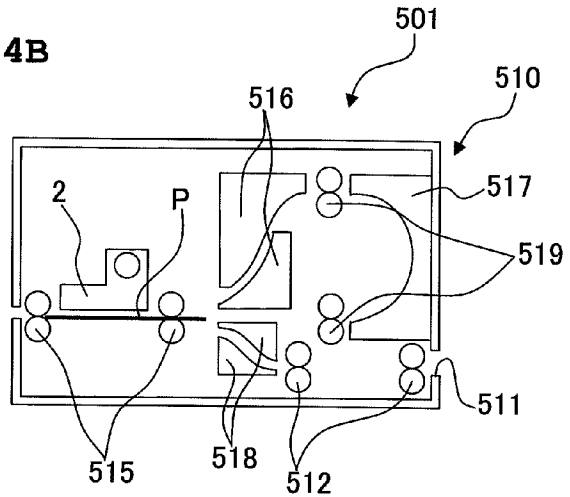
Figure 14C:
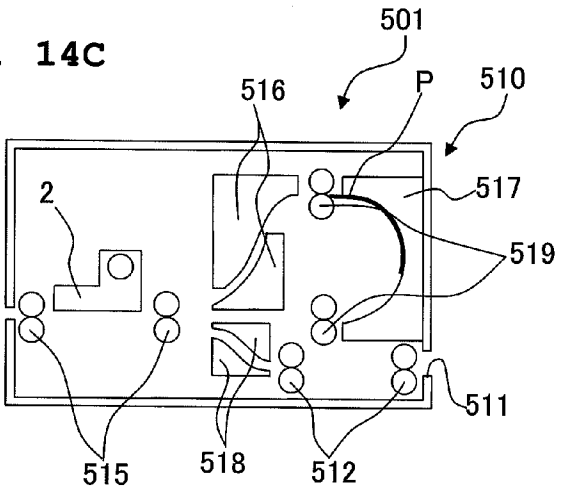
Figure 14D:
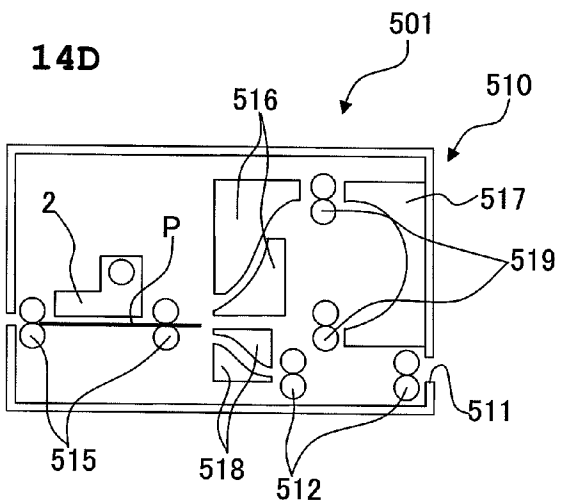
Figure 15:
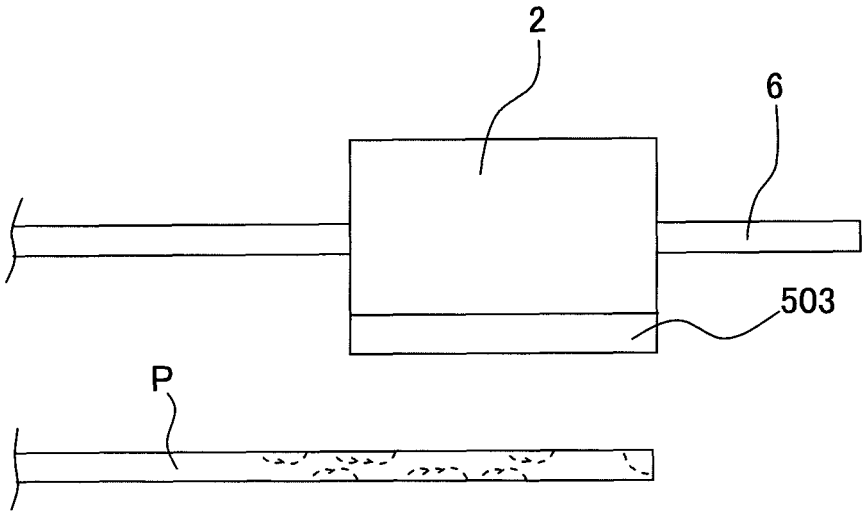
FIG. 15 shows a schematic plan view illustrating the printing operation on the recording paper by the ink-jet printer according to the fifth embodiment of the present invention.

Next, a fifth embodiment of the present invention will be explained. FIG. 13 shows a schematic sectional view illustrating an ink-jet printer according to the fifth embodiment of the present invention. FIG. 14A to 14D illustrate transport states of the recording paper in the ink-jet printer according to the fifth embodiment of the present invention, wherein FIG. 14A shows a situation in which the recording paper is fed, FIG. 14B shows a situation in which the printing operation is performed on one surface of the fed recording paper, FIG. 14C shows a situation in which the recording paper having been subjected to the printing operation on one surface is inverted, and FIG. 14D shows a situation in which the printing operation is performed on the other surface of the inverted recording paper. FIG. 15 shows a schematic plan view illustrating the printing operation on the recording paper by the ink-jet printer according to the fifth embodiment of the present invention.

As shown in FIG. 13, in the ink-jet printer 501 of this embodiment, an inverting mechanism 510 is added to the ink-jet printer 1 of the first embodiment, and the printing operation can be performed on the both surfaces of the recording paper P.

In the ink-jet printer 501, the recording paper P, which is fed from a paper supply port 511 (see FIG. 14A), is transported to an area opposed to an ink-jet head 503 by the aid of two pairs of rollers 512 and a guide member 518 (see FIG. 14B). In the ink-jet printer 501, the recording paper P, of one surface facing the ink-jet head 503, is fed to the inverting mechanism 510 by reversely rotating two pairs of rollers 515 shown in FIG. 13 (see FIG. 14C). After that, in the ink-jet printer 501, the recording paper P is inverted by guide members 516, 517 and two pairs of rollers 519 which constitute the inverting mechanism 510. The recording paper P is fed to the area opposed to the ink-jet head 503, and the other surface of the recording paper P is opposed to the ink-jet head 503 (see FIG. 14D). The respective two pairs of rollers 512, 515, 519 are driven and rotated by controlling an unillustrated motor by the control unit 6.

As shown in FIG. 15, when one surface of the recording paper P is opposed to the ink-jet head 503 (when the recording paper P and the ink-jet head 503 are opposed to one another for the first time in relation to one sheet of the recording paper P), the control unit 6 of the ink-jet printer 501 according to this embodiment controls the head driver 54 so that the ink droplets are jetted from the nozzles 40 to perform the ordinary jetting operation. When the other surface of the recording paper P is opposed to the ink-jet head 503 by the aid of the inverting mechanism 510 (when the recording paper P and the ink-jet head 503 are opposed to one another for the second time in relation to one sheet of the recording paper P), the control unit 6 controls the head driver 54 so that the ink liquid droplets are jetted from the nozzles 40 to perform the ordinary jetting operation and the marking jetting operation.

The ink (marking Pd), which is jetted onto the edge portion Pa of the recording paper P in the marking jetting operation, is more permeated in the thickness direction of the recording paper P as compared with the ink which is jetted onto the printing area Pb of the recording paper P in the ordinary jetting operation. Therefore, if the marking jetting operation is performed on one surface in addition to the ordinary jetting operation on the one surface (i.e., the first time ordinary jetting operation), and the recording paper P is inverted by the inverting mechanism 510, then the ink, which is permeated into the edge portion Pa of the recording paper P, is blurred.

Accordingly, when the marking jetting operation is performed together with the ordinary jetting operation on the other surface (i.e., the second time ordinary jetting operation), the ink, which is permeated into the edge portion Pa of the recording paper P, can be prevented from any blur, because the recording paper P is immediately discharged after the printing operation. It is also possible that the ordinary jetting operation is performed on only one surface of the recording paper P, and that the marking jetting operation is performed on the other surface. In this case, the marking Pd can be confirmed from the side end portion Pc of the recording paper P, while the marking Pd can be made inconspicuous from one surface on which the ordinary jetting operation is performed, by performing the marking jetting operation on the other surface.

Sixth Embodiment

Figure 16:
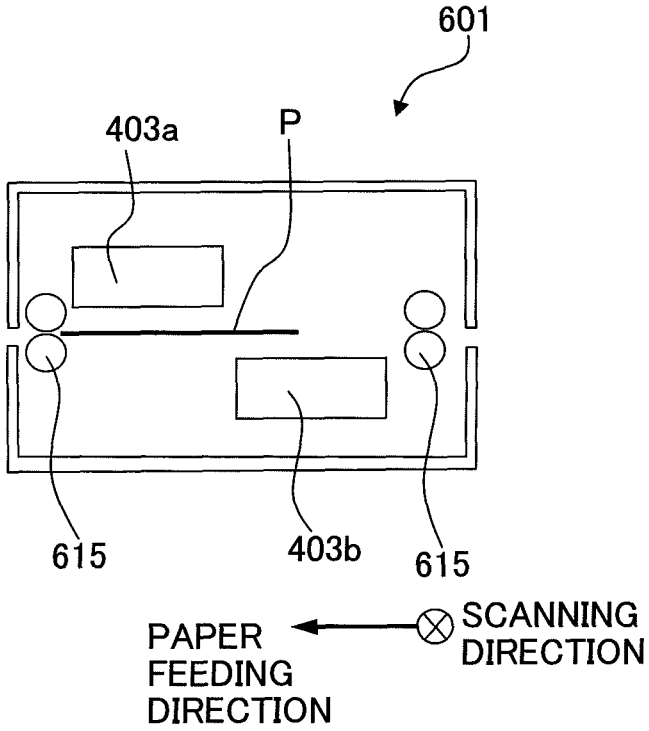
FIG. 16 shows a schematic sectional view illustrating an ink-jet printer according to a sixth embodiment of the present invention.

Next, a sixth embodiment of the present invention will be explained. FIG. 16 shows a schematic cross-sectional view illustrating an ink-jet printer according to the sixth embodiment of the present invention. In the ink-jet printer 601 of this embodiment, the line type ink-jet heads 403 of the fourth embodiment are provided so that they are opposed to the both surfaces of the recording paper P respectively. The printing operation can be performed on the both surfaces of the recording paper P.

The ink-jet printer 601 has the two line type ink-jet heads 403*a*, 403*b* which are opposed to the both surfaces of the recording paper P transported by two pairs of rollers 615 respectively. The two line type ink-jet heads 403*a*, 403*b* are constructed in the same manner as the ink-jet head 403 of the fourth embodiment. The nozzles, which are opposed to one surface of the recording paper P, are formed on the lower surface of the ink-jet head 403*a*. The nozzles, which are opposed to the other surface of the recording paper P, are formed on the upper surface of the ink-jet head 403*b*. The two ink-jet heads 403*a*, 403*b* are arranged at positions deviated from each other in the paper feeding direction.

The control unit 6 of the ink-jet printer 601 according to this embodiment is capable of controlling the head driver 54 so that the ink liquid droplets are jetted from the ink-jet heads 403*a*, 403*b* to perform the printing on the both surfaces of the recording paper P.

When the ordinary jetting operation is performed on only one surface of the recording paper P in the ink-jet printer 601, the marking jetting operation is performed on the other surface of the recording paper P. Specifically, the control unit 6 controls the head driver 54 so that the ink liquid droplets are jetted from the ink-jet head 403*a* to perform the ordinary jetting operation on the printing area Pb of one surface of the recording paper P opposed to the ink-jet head 403*a*, and the ink liquid droplets are jetted from the ink-jet head 403*b* to perform the marking jetting operation on the edge portion Pa of the other surface of the recording paper P opposed to the ink-jet head 403*b*.

Accordingly, the marking Pd can be confirmed from the side end portion Pc of the recording paper P, while the marking Pd can be made inconspicuous from one surface of the recording paper P on which the ordinary jetting operation is performed. In this embodiment, the ordinary jetting operation is performed on one surface of the recording paper P opposed to the ink-jet head 403*a*, and the marking jetting operation is performed on the other surface of the recording paper P opposed to the ink-jet head 403*b*. However, the marking jetting operation may be performed on one surface of the recording paper P opposed to the ink-jet head 403*a*, and the ordinary jetting operation may be performed on the other surface of the recording paper P opposed to the ink-jet head 403*b*.

Next, an explanation will be made about modified embodiments in which various modifications are applied to the first to sixth embodiments described above. In the embodiments described above, the marking is formed at the side end portion disposed in the paper feeding direction of the recording paper P. However, the marking may be formed at the side end portion disposed in the scanning direction (at the side end portion or portions disposed at the both ends in the paper feeding direction).

The marking may be formed not only at one side end portion disposed in the paper feeding direction of the recording paper P, but the marking or markings may be also formed at the other side end portion or the both side end portions, by controlling the head driver 54 by the control unit 6 to execute the marking jetting operation.

Further, the two ink-jet heads may be provided for the ordinary jetting operation and for the marking jetting operation, and the ordinary jetting operation and the marking jetting operation may be performed by controlling the respective ink-jet heads by the control unit. The larger amount of the ink is permeated in the thickness direction of the recording paper P in the marking Pd formed at the edge portion Pa of the recording paper P as described above, as compared with the portion onto which the inks are jetted in the printing area Pb. Therefore, it is considerably feared that the ink may be adhered to the paper discharge roller (for example, the transport rollers 5 and the pairs of rollers 615) arranged on the downstream side in the paper discharge direction as compared with the ink-jet head. Accordingly, the paper discharge roller is formed of a highly liquid-repellent material in the ink-jet printer according to any one of the embodiments and the modified embodiments described above, and thus it is possible to avoid the adhesion of the ink to the paper discharge roller. For example, a portion of the paper discharge roller, which makes contact with the recording paper, may be coated, for example, with a fluorine-based resin. Alternatively, when the area of the recording paper P, in which the marking Pd is formed, can be previously specified for the sheets of the recording paper P having various sizes, an area of the paper discharge roller, which is overlapped with the marking Pd, may be previously cut out. Also in this case, it is possible to avoid the adhesion of the ink to the paper discharge roller.

What is claimed is:

1. An ink-jet printer configured to perform printing on a sheet-shaped printing medium, comprising:

an ink supply portion through which an ink stored in an ink tank is supplied;

a transport mechanism configured to transport the printing medium in a predetermined transport direction;

an ink-jet head which is arranged to face one surface of the printing medium transported by the transport mechanism and in which a nozzle for jetting ink droplets of the ink supplied from the ink tank toward the printing medium is formed;

an inverting mechanism configured to invert the printing medium; and a controller configured to control the ink-jet head to perform an ordinary jetting operation and a marking jetting operation, the ordinary jetting operation being an operation in which the ink droplets are jetted toward an area of the printing medium, different from an edge portion of the printing medium, and the marking jetting operation being an operation in which the ink droplets are jetted toward a part of the edge portion of the printing medium, wherein the controller is configured to control the ink-jet head and the inverting mechanism such that only the ordinary jetting operation is performed on the one surface of the printing medium without performing the marking jetting operation, and the marking jetting operation is performed on the other surface of the printing medium after inverting the printing medium with the inverting mechanism.

* * * * *